US005584681A

United States Patent [19]

Suzuki

[11] Patent Number: 5,584,681

[45] Date of Patent: Dec. 17, 1996

[54] GAS LIGHTER

[76] Inventor: Nariaki Suzuki, 61-7 Yayoityo Itabashi-ku, Tokyo, Japan

[21] Appl. No.: 170,530

[22] Filed: Dec. 20, 1993

[30] Foreign Application Priority Data

Dec. 28, 1992 [JP] Japan ..... 4-093638 U

[51] Int. Cl.[6] ..... F23Q 2/08

[52] U.S. Cl. ..... 431/132; 431/255

[58] Field of Search ..... 431/132, 255

[56] References Cited

U.S. PATENT DOCUMENTS 5,055,034 10/1991 Wang ..... 431/255

5,308,240 5/1994 Lowenthal ..... 431/132

*Primary Examiner*—Carroll B. Dority

*Attorney, Agent, or Firm*—Frishauf, Holtz, Goodman & Woodward, PC

[57] ABSTRACT

Disclosed is a gas lighter easy to use, capable of stably maintaining a diffusion flame allowing a visual confirmation of the combustion condition and criticality, irrespective of use in the place influenced by the wind or the like. Further provided is a gas lighter capable of externally performing a fuel gas flow control with ease to maintain a combustion balance between a premix flame and a diffusion flame. The fuel gas stored within the fuel tank is distributed for ejection to form a premix flame and a diffusion flame burning together with the premix flame. A flame hole for premix flame is juxtaposed with a nozzle hole for fuel gas to generate the diffusion flame. An externally operable fuel gas flow control mechanism is provided in a fuel gas flow passage for producing the diffusion flame. A combustion flame of the gas mixture is produced downstream of a catalytic member. A catalytic reaction due to the catalytic member is effectively utilized from the initiation of ignition to produce a diffusion flame having a clearer combustion criticality.

6 Claims, 10 Drawing Sheets

GAS LIGHTER

BACKGROUND OF THE INVENTION

1. Field of the Invention

The present invention relates generally to a gas lighter and, more particularly, to a gas lighter capable of maintaining a continuous combustion by ensuring a diffusion flame in the form of an ordinary reddish yellow visible flame which is not to be extinguished under the influence of the wind or the like.

2. Description of the Related Arts

A diffusion flame is in general used as a flame for a gas lighter. The diffusion flame inconveniently has a poor wind resistance and, for outdoor use especially, may present unstable lighting and burning properties. Thus, in view of the wind resistance, there has been recently developed a mechanism in which a premix gas is ignited and burned within a combustion cylinder.

However, a premix flame obtained by burning the premix gas is in the state of a complete combustion, whose color is a pale blue white, making it difficult to visually confirm the state of combustion in a light place under, e.g., daylight. In order to compensate for such state and reignite the gas in case of extinction due to the wind or the like, there has also been developed a technique in which a metal wire or catalytic member is mounted on the opening of the combustion cylinder to maintain a red heating state. Such red heated metal wire or catalytic member merely shows the presence of a combustion within the interior of the combustion cylinder, but does not exhibit any confirmation of the size of the flame exposed from the opening of the combustion cylinder upon igniting the object to be lit, in other words, the ejection amount of the gas mixture for producing a combustion criticality.

With the aim of ensuring easy visual confirmation of a combustion criticality of the premix flame, there has also been developed a mechanism in which a fuel gas ejected from the fuel tank is caused to diverge to form a second fuel gas ejection flow passage whose leading edge is introduced into the interior of the combustion cylinder. In this case, also, due to some factors such as size of the combustion cylinder or mutual variation in ejection amounts of the premixed gases subjected to a complete combustion and of the fuel gas for producing a diffusion flame through the ejection from the second fuel gas ejection flow passage, the fuel gas ejected from the second fuel gas ejection flow passage may not be allowed to form a diffusion flame, which results in an assimilation with the premix flame to be produced within the combustion cylinder. Thus, unstable factors disadvantageously remain intact.

In order to obtain the premixed gas, within a flow passage for a fuel gas there must be arranged a nozzle hole (orifice) for increasing a jet flow rate for the fuel gas and for sucking the ambient air by its negative pressure. On the contrary, there must be controlled a gas ejection amount of a second fuel gas ejection flow passage and a gas flow ejected from the nozzle hole to obtain a premixed gas so as to present a mutually balancing combustion. To balance the mutual combustion, there is further disposed a second nozzle hole (orifice) for controlling the gas ejection amount in the middle of the second gas ejection flow passage, thereby obtaining a combustion flame which is useful for igniting objects to be lit and is not influenced by the wind or the like.

However, in order to controllably balance the ejection amounts of the fuel gas, it is required to construct the mutual nozzle holes (orifices) at a very minute machining accuracy in microns, which will actually be extremely difficult. Moreover, there is inevitably a structural difference in flow passage resistance between the fuel gas ejection flow passage for producing a premix flame and the fuel gas ejection passage for producing a diffusion flame, which structural difference will result in a difference in the gas ejection pressure. This means that it is difficult to obtain an ideal mutual combustion condition even if the two nozzle holes are numerically well balanced.

In the conventional gas lighter, a catalytic member is attached to the opening of a combustion cylinder for the confirmation of combustion or reigniting operation. A red heating of the catalytic member in the initial ignition arises from a combustion heat of the gas mixture within the combustion cylinder. When a combustion flame is distinguished due to any phenomena, continuously ejecting mixed gas will react with the catalytic member to generate a reaction heat which in turn causes a regeneration of the premix flame in the exterior of the combustion cylinder. In this conventional gas lighter, the premixed gas has its combustion base located at a deeper point within the combustion cylinder in the combustion condition at the time of initial ignition, and the catalytic member provided on the opening of the combustion cylinder is not allowed to react. Thus, the premix flame may be forced to jet up to the outside of the opening of the combustion cylinder in such a manner that the diffusion flame which is a visible flame is assimilated with the premix flame, which leads to an unclear combustion criticality of the diffusion flame.

SUMMARY OF THE INVENTION

The present invention was conceived in view of the problems involved in the prior art techniques described above. It is therefore an object of the present invention to provide a gas lighter ensuring a stable diffusion flame in the form of a visible flame, or a good wind resistance and easy visual confirmation of flame combustion criticality, and capable of continuously maintaining the flame and easily lighting a cigarette or other objects to be lit, and exhibiting an improved assembly workability.

Another object of the present invention is to provide a gas lighter capable of externally performing fuel gas flow control with ease to maintain a combustion balance between the premix flame and the diffusion flame, and effectively utilizing the catalytic reaction due to the catalytic member at the time of initial ignition to produce a diffusion flame having a clearer combustion criticality.

In order to accomplish the above object, the gas lighter according to the first aspect of the present invention comprises a flame hole allowing a production of premix flame and a nozzle hole allowing a production of diffusion flame, both the holes being juxtaposed with each other.

In order to achieve the above object, the gas lighter according to the second aspect of the present invention, which has a fuel tank storing a fuel gas, the fuel gas being distributed for ejection to produce a premix flame and a diffusion flame burning together with the premix flame, comprises a passage for a gas producing the diffusion flame; and a fuel gas flow control mechanism provided in the gas passage and allowing the flow of the gas passage to be externally operated.

Such configuration ensures that a diffusion flame originating from a premix flame having a good wind resistance is not to be extinguished under the influence of the wind or the like. More specifically, while the base of the premix flame is held within the interior of the combustion barrel communicating with the flame hole to secure a wind resistance, the diffusion flame whose combustion criticality is visually confirmed is produced in juxtaposition with the flame hole, thereby maintaining the flame in a stable manner.

Such configuration further ensures that the fuel gas ejection amount in the gas flow passage for the generation of a diffusion flame is properly balanced with the mutual ejection amounts of fuel gases for producing a premixed gas by an external operation to thereby obtain an ideal combustion flame well balanced with the premix flame. Further, the combustion downstream of the catalytic member ensures that the combustion constantly accompanied by the catalytic reaction will be obtained in the combustion cylinder, which will result in a clearer combustion criticality and an effective diffusion flame free from a red heating due to the combustion heat.

BRIEF DESCRIPTION OF THE DRAWINGS

These and other objects and advantages of the present invention will become more apparent, when viewed in conjunction with the following drawings, in which.

DESCRIPTION OF THE PREFERRED EMBODIMENTS

Figure 1:
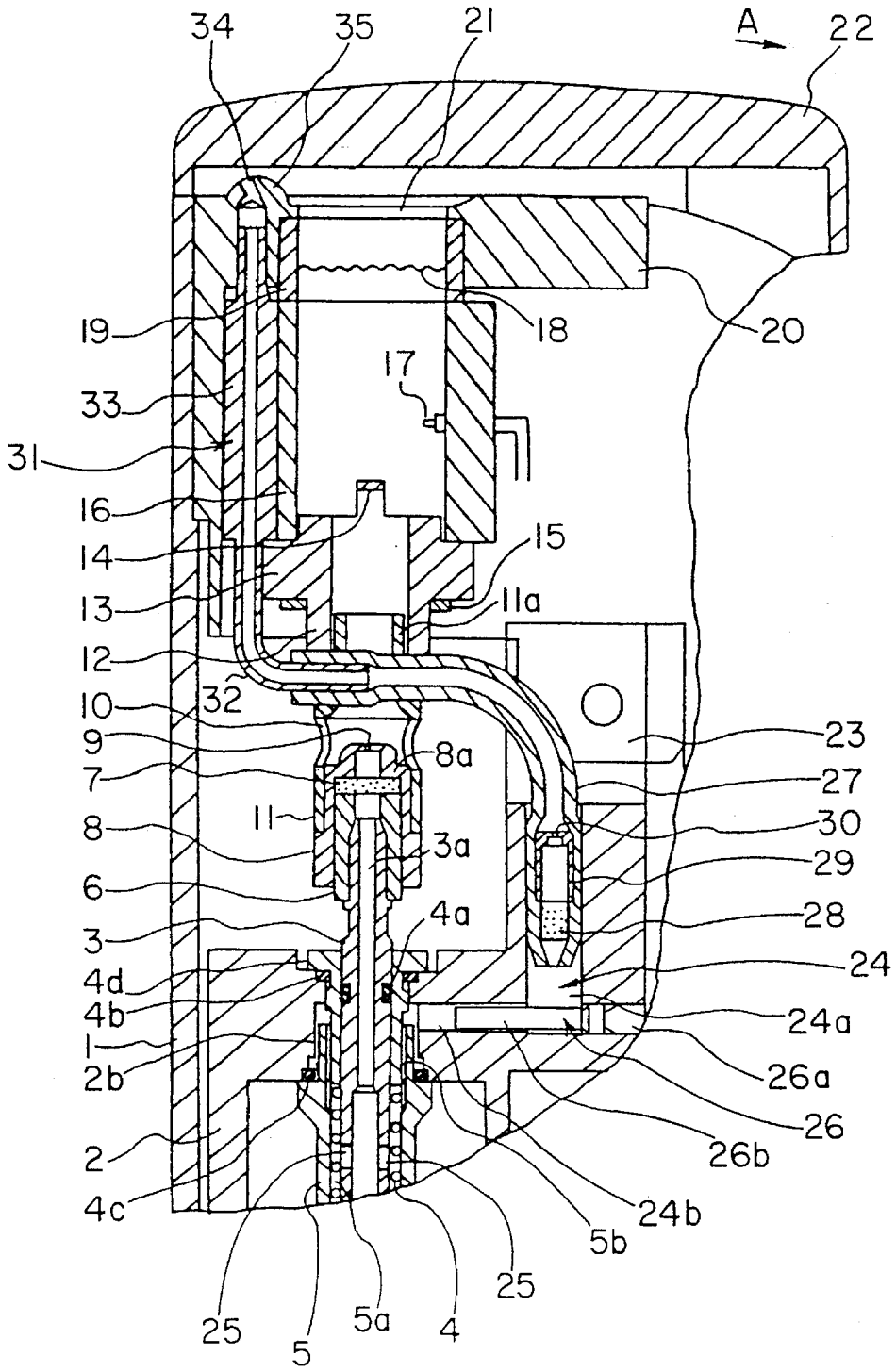
FIG. 1 is a longitudinal sectional view showing a principal part of a gas lighter which is a first embodiment of the present invention.
Figure 2:
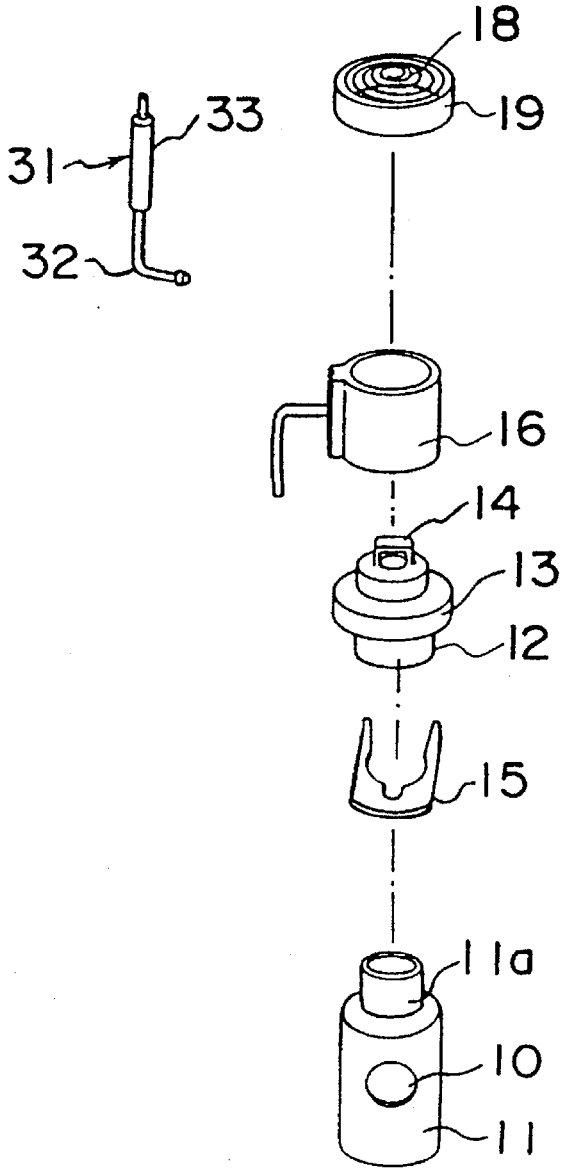
FIG. 2 is an exploded perspective view showing a flow passage mechanism for a premixed gas, and a tip nozzle pipe through which a fuel gas for producing a diffusion flame is ejected.
Figure 3:
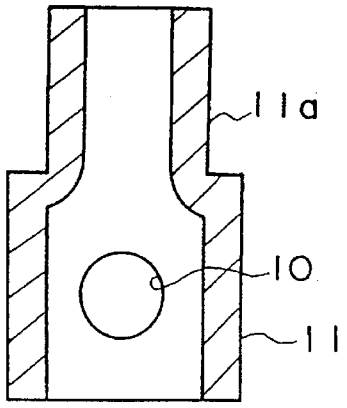
FIG. 3 is a longitudinal sectional view of a mixer tube.
Figure 4:
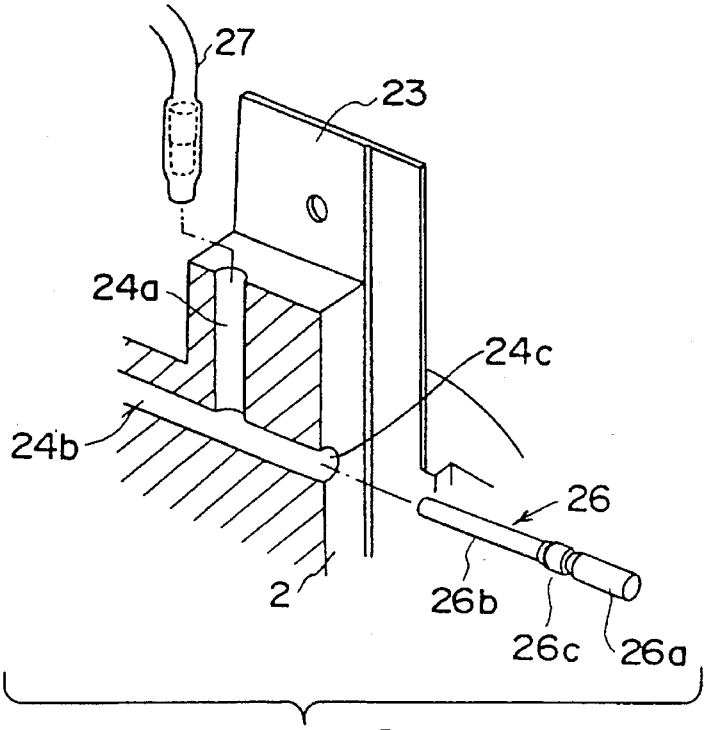
FIG. 4 is a partially cut-away exploded perspective view showing a connection part of gas fluid passages through which the fuel gas for producing a diffusion flame is supplied into the tip nozzle pipe.
Figure 5:
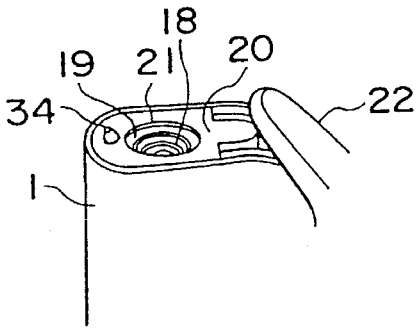
FIG. 5 is a fragmentary perspective view showing a closure being opened.

A first embodiment of present invention will now be described with reference to the accompanying drawings, in which identical parts are marked by the same reference numerals. FIG. 1 is a partially longitudinal sectional view showing a principal part of a gas lighter embodying the present invention; FIG. 2 is an exploded perspective view showing a flow passage mechanism for a premixed gas, and a tip nozzle pipe through which a fuel gas for producing a diffusion flame is ejected; FIG. 3 is a longitudinal sectional view of a mixer tube; FIG. 4 is a partially cut-away exploded perspective view showing a connection part of fluid passages through which the fuel gas for producing a diffusion flame is supplied into the tip nozzle pipe; and FIG. 5 is a fragmentary perspective view showing a closure being opened.

In the diagrams, reference numerals 1 and 2 denote a case and a fuel tank disposed within the case, respectively. The fuel tank 2 includes a suction tube 5 for fuel gas communicating with a fuel gas ejection flow control mechanism (not shown) and receiving the lower end portion of a joint pipe 3. Between the outer periphery of the lower end portion of the joint pipe 3 and the inner periphery of the suction tube 5, there is defined a gas suction passage 5*a* leading into an on-off valve mechanism (not shown) which allows the fuel gas to be ejected from the fuel tank 2. The suction passage 5*a* houses a coil spring 4 which biases the on-off valve mechanism. The joint pipe 3 includes supply holes 25, 25 communicating with the suction passage 5*a* and supplying the fuel gas into the pipe bore 3*a* so as to form a first gas ejection flow passage (hereinafter, referred to as a first flow passage) through which the fuel gas is ejected from the top portion of the joint pipe 3.

The joint pipe 3 has along the outer periphery at its distal end a gas ejection barrel 8 fitted thereinto so as to constitute the first flow passage by way of a press-fitted tube packing 6 for preventing a gas leakage. The gas ejection barrel 8 includes at its top surface a nozzle hole 9 having a minute diameter for increasing a gas ejection flow rate.

In order to filtrate gas impurities, a filter 7 made of, e.g., sintered metals, ceramics, or fiber materials is clamped between the tube packing 6 and an inner shoulder 8*a* of the gas ejection barrel 8 in the middle of a flow passage extending from the pipe bore 3*a* of the joint pipe 3 to the nozzle hole 9 for ejecting a gas. In the diagrams, reference numeral 2*b* denotes a mounting hole provided on the fuel tank 2 to receive the suction tube 5, and reference numerals 4*a*, 4*b* and 4*c* denote an O-ring fitted in a ring groove of the joint pipe 3, an O-ring attached between a mounting nut 4*d* and the top opening of the mounting hole 2*b*, and an O-ring interposed between the suction tube 5 and the mounting hole 2*b*, respectively, the O-rings 4*a*, 4*b*, 4*c* serving to prevent a gas leakage.

A mixer tube 11 has a lower end press-fitted into the upper end of the gas ejection barrel 8, and includes suction ports 10, 10 opening into the interior. The nozzle hole 9 of the gas ejection barrel 8 is located within the mixer tube 11 so that air is introduced through the suction ports 10, 10 by virtue of the ejection effect of a fuel gas ejected from the nozzle hole 9 to produce a fuel gas-air mixture (or premixed gas).

The upper end 11*a* of the mixture tube 11 is loosely fitted into the lower end opening of a diffuser 12 so as to permit a vertical movement of the on-off valve mechanism when introducing the gas from the fuel tank 2 into the suction tube 5. The diffuser 12 has at its outer periphery a flange 13 integrally formed therewith, and at its upper end opening a diffusion wall 14 against which the premixed gas impinges to cause a deceleration and diffusion of the gas.

The upper shoulder of the flange 13 of the diffuser 12 abuts against the lower end of a combustion cylinder 16 which includes an inwardly facing discharge electrode 17 electrically connected to a high-voltage generating mechanism (not shown) for generating an energy igniting the premixed gas.

On the opening of the combustion cylinder 16 there is mounted a ring member 19 which supports a catalytic metal wire 18 spirally formed in this embodiment and causing a red heat through a catalytic reaction. The ring member 19 communicates with a flame hole 21 for premix flame obtained by burning the premixed gas ejected through the first flow passage within the combustion cylinder 16, and opens in the top surface of a flame hole cover 20 firmly secured to the opening of the case 1. On the underside of the flange 13 of the diffuser 12, there is arranged a fixing washer 15 intended to fixedly attach the ring member 19 and combustion cylinder 16 to the flame hole cover 20 at its predetermined location.

In this embodiment, on the other hand, there is formed a connecting passage 24 for producing a diffusion flame though the provision of a second gas ejection flow passage (hereinafter, referred to as second flow passage) allowing the gas from the on-off valve mechanism of the fuel tank 2 to diverge into the suction passage 5*a*. The connecting passage 24 is composed of a vertical passage 24*a* and a transverse passage 24*b*. The transverse passage 24*b* and the suction passage 5*a* define a gap 5*b* in cooperation with the lower end outer periphery of the mounting nut 4*d* of the joint pipe 3 and the upper end inner periphery of the suction tube 5. The gap 5*b* constitutes a part of the second flow passage for the fuel gas. The transverse passage 24, as shown in FIG. 4, includes a through-hole 24*c* opening to the outside of the wall of the fuel tank 2. A plug portion 26*a* of a plug rod 26 is press-fitted into the through hole 24*c* so as to hermetically seal the latter.

The plug rod 26 further includes an insertion portion 26*b* having a slightly smaller diameter than the plug portion 26*a*. The plug portion 26*a* has a locking groove 26*c* for preventing a disengagement from the through-hole 24*c*. The insertion portion 26*b* lies within the transverse passage 24*b* so as to reduce the volume of the flow passage of the fuel gas, thereby suppressing the amount of the residence gas.

On the contrary, one end of a flexible joint tube 27 made of a resilient material is press-fitted into the vertical passage 24*a*. A filter 28 and a second gas ejection barrel 29 are fitted into the joint tube 27. The second gas ejection barrel 29 is provided with a nozzle hole 30 having a hole diameter ensuring a gas ejection force which balances with a combustion condition presented by the nozzle hole 9 of the gas ejection barrel 8. The outer diameter of the second gas ejection barrel 29 is slightly larger than the inner diameter of the joint tube 26 so that the insertion of the ejection barrel 29 can swell out the outer diameter of the joint tube. Thus swollen joint tube end is press-fitted into the vertical passage 24*a* so as to heighten a contact pressure with the inner wall of the vertical passage 24*a* which is a rigid body, thereby preventing a side leakage of the fuel gas. The swell of the joint tube 27 will also contribute to a prevention of a disengagement from the vertical passage 24*a*, irrespective of a raised pressure due to gas ejection amount restrained by the nozzle hole 30 of the second gas ejection barrel 29. This will also facilitate the configuration of the connection means for the second flow passage and its assembly work.

It is to be noted that the joint tube 27 detours around the region of the first flow passage and is fitted into a rear end bent portion 32 of a tip nozzle pipe 31. The tip nozzle pipe 31 has a larger diameter section 33 which is clamped by the inner wall surface of the tip nozzle cover 20 and the outer wall surface of the combustion cylinder 16 and whose lower end is partly supported on the flange 13 of the diffuser 12.

The distal end of the tip nozzle pipe 31 leads to a nozzle hole 34 through which a burning fuel gas is ejected in a diffuse manner, the nozzle hole 34 being provided on the top surface of the flame hole cover 20. The nozzle hole 34 is provided in a swell portion 35 so as to allow a diagonally upward ejection, in the outer vicinity with respect to the axis of the flame hole 21 for premix flame obtained by burning the premixed gas derived from the first flow passage. Although the nozzle hole 34 is formed separately from the tip nozzle pipe 31 in this embodiment, the distal end of the tip nozzle pipe 31 may be formed integrally with the nozzle hole 34 without being limited to it.

In the diagrams, reference numeral 22 denotes a closure fitted to the top of the case 1, and 23 denotes a support piece formed on the fuel tank 2 and supporting a pivot shaft (not shown) of the closure 22.

Description will now be given of action of the gas lighter thus configured in accordance with the present invention.

When the closure 22 is turned in the direction indicated by an arrow A, a nozzle lever (not shown) pulls up the joint pipe 3 to release the on-off valve mechanism, thereby allowing the fuel gas derived from the fuel tank to be ejected and through the suction passage 5*a* diverge into the bore 3*a* and the connecting passage 24. With the ejection of the fuel gas, the high-voltage generator is actuated to generate a discharge between the discharge electrode 17 and the diffusion wall 14 within the combustion cylinder 16. The resultant discharge spark ignites the premixed gas within the combustion cylinder 16 to produce a premix flame in a complete combustion state, the top surface of the diffusion wall 14 of the diffuser 12 acting as the base for the combustion flame.

On the contrary, the nozzle hole 34 permits an ordinary fuel gas to be ejected through the tip nozzle pipe 31. The fuel gas ejected from the nozzle hole 34 is ignited by the premix flame ejected from the flame hole 21. This ignition results in a diffused visible flame exhibiting an ordinary reddish yellow, which has a narrower and higher combustion state than the premix flame by virtue of the construction of the tip nozzle pipe 31. Since the nozzle hole 34 is located in the outer vicinity with respect to the axis of the flame hole 21 and is so formed as to allow a diagonally upward ejection, the diffusion flame may be produced in the upwardly diagonal direction if it is employed alone. Nevertheless, the flow rate of the combustion gas flow ejected from the flame hole 21 will correct it into the substantially orthogonal direction.

Namely, by virtue of the premix flame being ejected from the flame hole 21, the diffusion flame which is a colored visible flame generated by a fuel gas ejected from the nozzle hole 34 can maintain a stable combustion without being blown out under the influence of the wind or the like. In case the premix flame is extinguished by a direct blow of the wind into the interior of the combustion cylinder 16, the premix gas is reignited by the reaction heat of the catalytic metal wire 18, which also reignites the fuel gas being ejected from the nozzle hole 34.

Since the gas lighter of the present invention is configured and operated as described above, the diffusion flame which is a colored visible flame can be stably maintained even in the place subjected to the influence of the wind or the like, which is very useful. Such configuration will eliminate any possibility of causing trouble and ensure a good assembly workability.

While an illustrative and presently preferred embodiment of the present invention has been described in detail herein, it is to be understood that the inventive concepts may be otherwise variously embodied and employed and that the appended claims are intended to be construed to include such variations except insofar as limited by the prior art.

Figure 6:
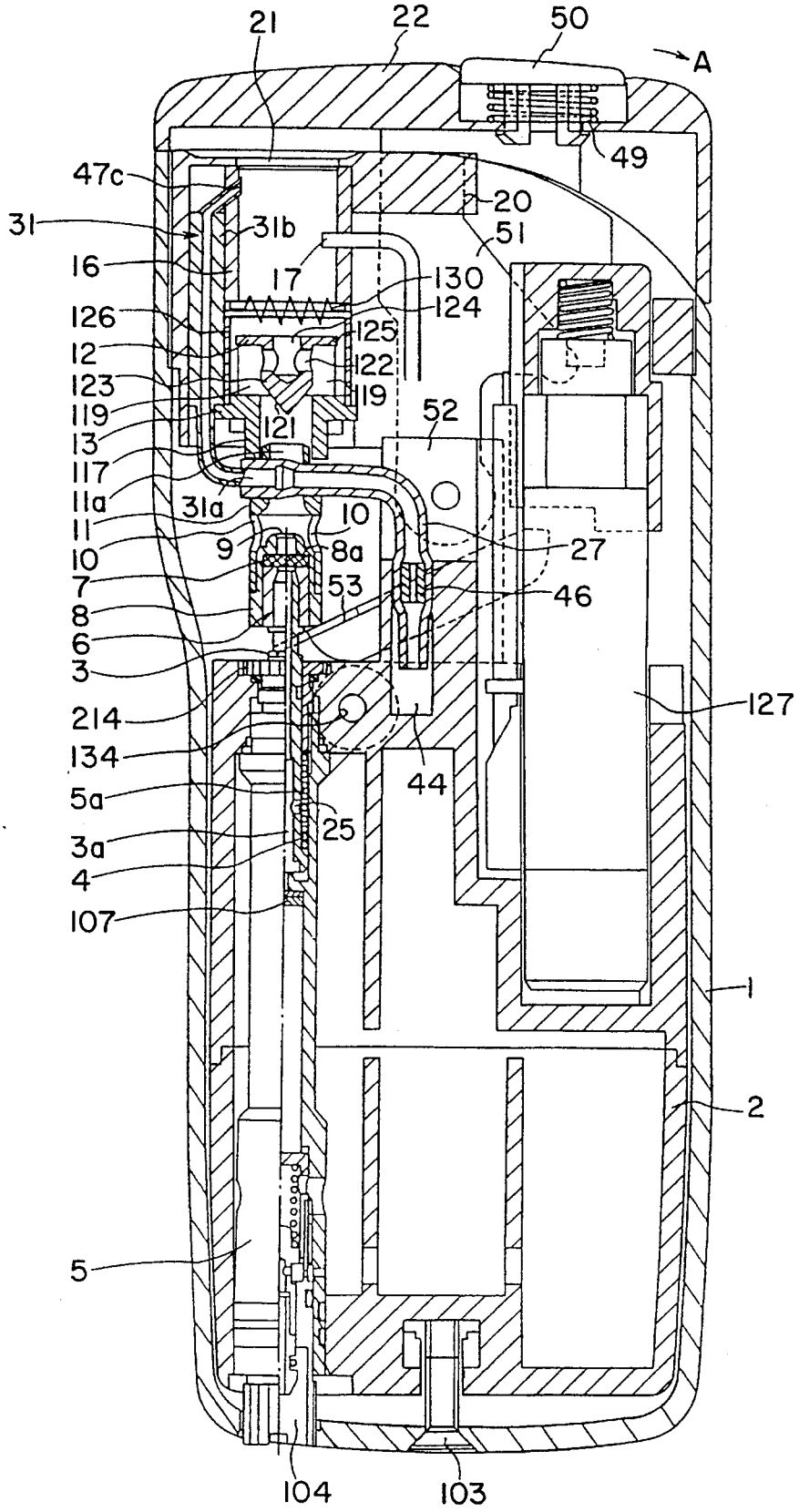
FIG. 6 is a longitudinal sectional view of a gas lighter which is a second embodiment of the present invention.
Figure 7:
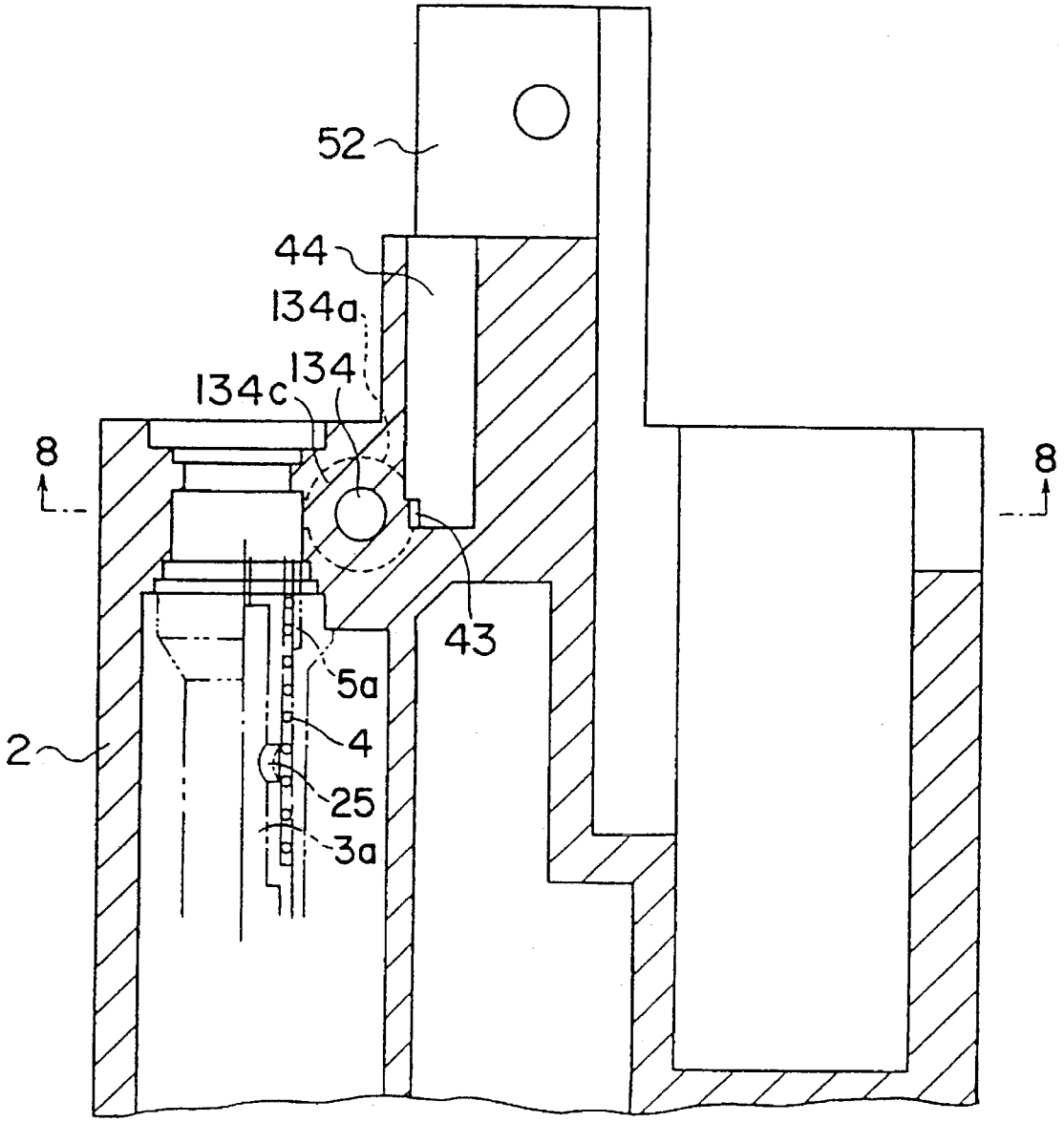
FIG. 7 is a longitudinal sectional view showing the upper part of a fuel tank of the gas lighter.
Figure 8:
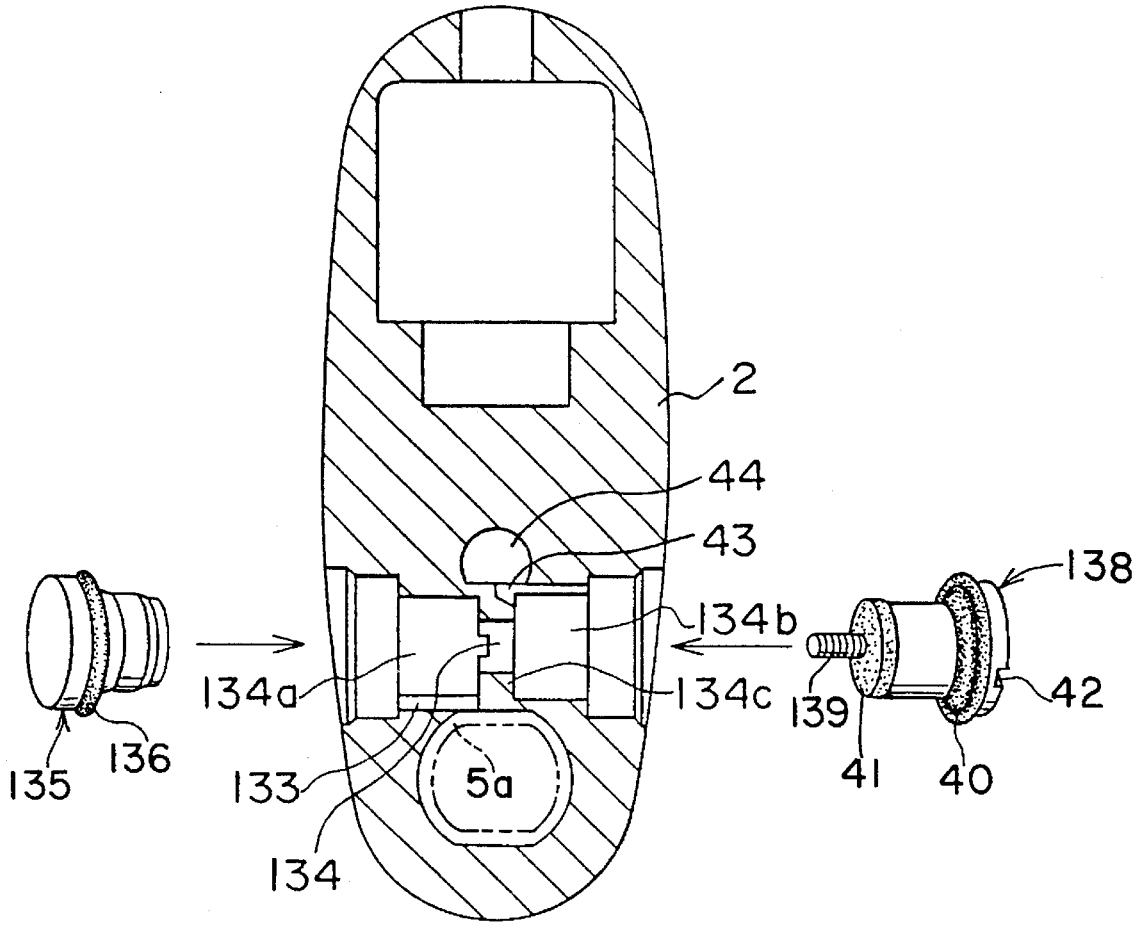
FIG. 8 is a sectional view taken along a line 8—8 of FIG. 7.
Figure 9:
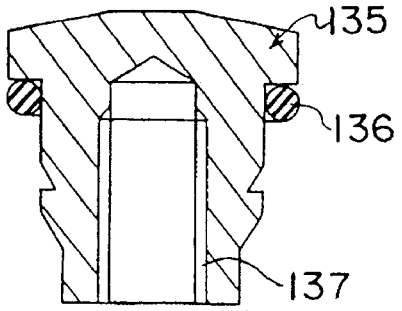
FIG. 9 is a sectional view of a receiving member.
Figure 10:
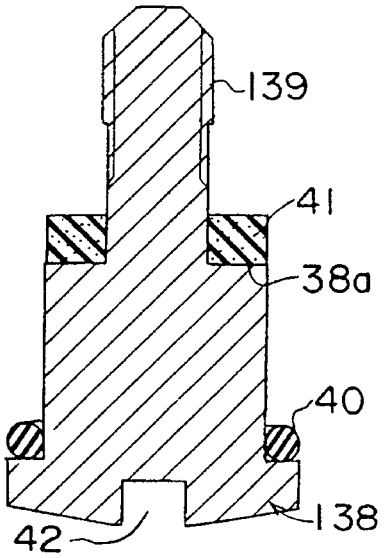
FIG. 10 is a sectional view of a movable member.
Figure 11:
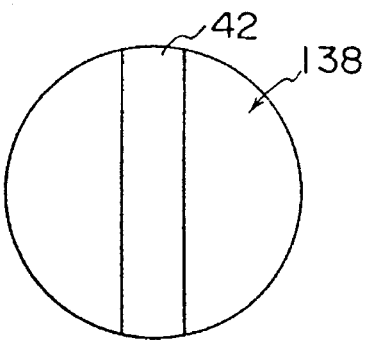
FIG. 11 is a top plan view of the movable member.
Figure 12:
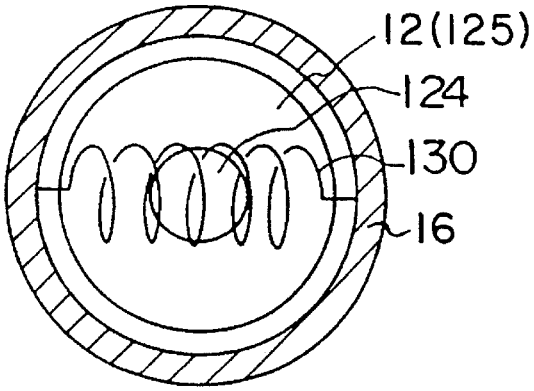
FIG. 12 is a top plan view showing a mounting structure for a catalytic member.
Figure 13:
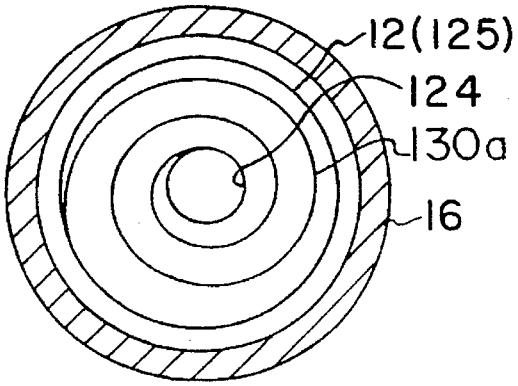
FIG. 13 is a top plan view showing a mounting structure for another catalytic member.
Figure 14A:
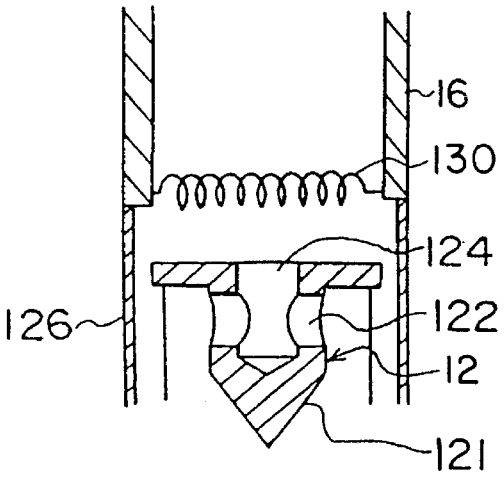
FIG. 14A is a sectional view showing a mounting structure for a catalytic member.
Figure 14B:
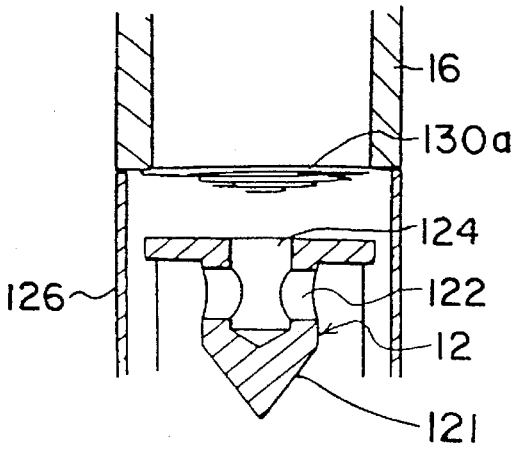
FIG. 14B is a sectional view showing a mounting structure for another catalytic member.
Figure 15:
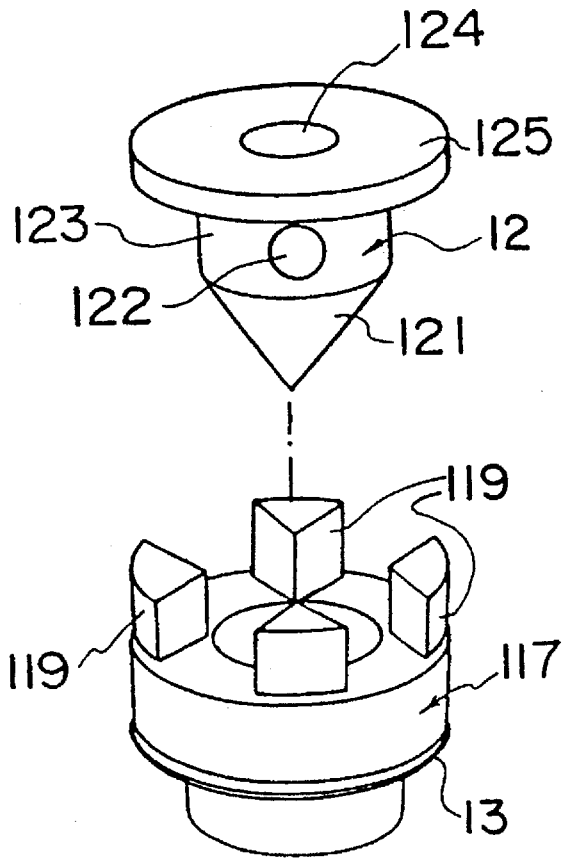
FIG. 15 is an exploded perspective view showing a diffuser and a diffuser holder.

A second embodiment of the present invention will now be described with reference to the accompanying drawings. FIG. 6 is a longitudinal sectional view showing a gas lighter embodying the present invention; FIG. 7 is a longitudinal sectional view showing the upper portion of a fuel tank; FIG. 8 is a sectional view taken along a line 8—8 in FIG. 7; FIG. 9 is a longitudinal sectional view of a support member; FIG. 10 is a partially sectional front elevation showing a movable member screwed with the support member; FIG. 11 is a top plan view thereof; FIG. 12 is a top plan view showing a mounting structure for a catalytic member; FIG. 13 is a top plan view showing another mounting structure for the catalytic member; FIGS. 14A and 14B are sectional views showing mounting structures, respectively; and FIG. 15 is an exploded perspective view showing a diffuser and a diffuser holder.

In the diagrams, reference numerals 1 and 2 denote a case and a fuel tank disposed within the case, respectively. The fuel tank 2 is fixed to the case 1 through a screw 103. The fuel tank 2 includes a suction tube 5 for fuel gas communicating with a fuel gas ejection flow control mechanism 104 and receiving the lower end portion of a joint pipe 3. Between the outer periphery of the lower end portion of the joint pipe 3 and the inner periphery of the suction tube 5, there is defined a gas suction passage 5*a* leading into an on-off valve mechanism 107 which allows the fuel gas to be ejected from the fuel tank 2. The suction passage 5*a* houses a coil spring 4 which biases the on-off valve mechanism. The joint pipe 3 includes supply holes 25, 25 communicating with the suction passage 5*a* and supplying the fuel gas into the pipe bore 3*a* of the joint pipe 3 so as to form a first gas ejection flow passage (hereinafter, referred to as a first flow passage) through which the fuel gas is ejected from the top portion of the joint pipe 3.

The joint pipe 3 has along the outer periphery at its distal end a gas ejection barrel 8 fitted thereinto so as to constitute the first flow passage by way of a press-fitted tube packing 6 for preventing a gas leakage. The gas ejection barrel 8 includes at its top surface a nozzle hole or orifice 9 having a minute diameter for increasing a gas ejection flow rate.

In order to filtrate gas impurities, a filter 7 made of, e.g., sintered metals, ceramics, or fiber materials is clamped between the tube packing 6 and an inner shoulder 8*a* of the gas ejection barrel 8 in the middle of a flow passage extending from the pipe bore 3*a* of the joint pipe 3 to the nozzle hole 9 for ejecting a gas. In FIG. 6, reference numeral 214 denotes a mounting nut for mounting the suction tube 5 onto the fuel tank 2.

A mixer tube 11 has a lower end press-fitted into the upper end of the gas ejection barrel 8, and includes suction ports 10, 10 opening into the interior. The orifice 9 of the gas ejection barrel 8 is located within the mixer tube 11 so that air is introduced through the suction ports 10, 10 by virtue of the negative pressure effect of a fuel gas ejected from the nozzle hole 9 to produce a fuel gas-air mixture (or premixed gas).

The upper end 11*a* of the mixture tube 11 is loosely fitted into the lower end opening of a diffuser holder 117 so as to permit a vertical movement of the on-off valve mechanism 107 when introducing the gas from the fuel tank 2 into the suction tube 5. The diffuser holder 117 has at its outer periphery a flange 13 integrally formed therewith, and in this embodiment around its top opening four fan-shaped columns 119 into which the lower end of the diffuser 12 is fixedly press-fitted.

The diffuser 12 has at its lower end an inverted cone-shaped diffusion wall 121 which is loosely fitted into the top opening of the diffusion holder 117 and against which the gas mixture impinges for decelerating diffusion. The diffusion wall 121 is continuous with a cylindrical portion 123 having a transverse hole 122. The cylindrical portion 123 includes at its top a disk portion 125 having at its center a vertical hole 124 communicating with the transverse hole 122. That is, the gas mixture which has been decelerated by the diffusion wall 121 is distributed into the flow passage extending from the transverse hole 122 to the vertical hole 124 and into the flow passage leading to the side of the cylindrical portion 123 and the disk portion 125. It is to be appreciated that the shape and structure of the diffuser 12 may be appropriately employed depending on the factors such as size of the combustion cylinder or gas flow which will be described later, and that they are not limited to this embodiment.

The flange 13 of the diffusion holder 117 has at its top a spacer ring 126 whose lower end is fitted into the diffuser holder 117 in an abutting manner. The spacer ring 126 surrounds the diffuser 12. The spacer ring 126 has a top opening receiving a coiled catalytic member 130 fastened thereto at a location immediately above the diffuser 12.

The lower end of the combustion cylinder 16 is coupled with the top surface of the spacer ring 126 in an abutting manner. The top surface of the combustion cylinder 16 communicates with the flame hole 21 which opens into the flame hole cover 20 fixed to the opening of the case 1. A discharge electrode 17 for generating an ignition energy for the premix gas which is electrically connected to a high-voltage generating mechanism 127 faces the interior of the combustion cylinder 16.

In this embodiment, on the other hand, the fuel gas ejected from the fuel tank 2 into the suction passage 5*a* diverges to form a second gas ejection flow passage (hereinafter, referred to as a second flow passage) in the following manner. A partition wall 134*c* having a through-hole 134 is partly provided in the fuel tank 2. One side (left side in FIG. 8) of the partition wall 134*c* is provided with a mounting hole 134*a* for a receiving member 135 described later, while the other side (right side in FIG. 8) thereof is provided with a mounting hole 134*b* for a movable member 138 described later which is symmetrical with the mounting hole 134*a*. The mounting hole 134 for the receiving member 135 is fitted with a key groove 133 leading to the suction passage 5*a* so as to introduce the fuel gas into the mounting hole 134*a*. An O-ring 136 for preventing a gas leakage is attached around the outer periphery of the receiving member 135 to be press-fitted into the mounting hole 134. The receiving member 135 has an internal thread 137.

The movable member 138 is fitted into the mounting hole 134*b* in such a manner that an external thread formed on the distal end of the movable member 138 is screwed into the internal thread 137 of the receiving member 135 by way of the through-hole 134. The O-ring 40 for preventing a gas leakage is fitted around the outer periphery of the movable member 138. The external or male thread 139 has at its base end a pressure control member 41 for controlling the gas ejection flow having a ring shape whose one side abuts against a shoulder 38*a*. When the movable member 138 is screwed into the receiving member 135, the other side of the pressure control member 41 is allowed to abut against the partition wall 134*c*. Reference numeral 42 denotes an operation groove for rotationally operating the movable member 138.

The mounting hole 134*b* for the movable member 138 is provided with a fuel gas flow groove 43 communicating with the lower end of the vertical hole 44. The vertical hole 44 receives one end of a flexible joint tube 27 press-fitted thereinto. A pipe member 46 is fitted into the joint tube 27 to stabilize the press-fitting condition into the vertical hole 44. By press-fitting the joint tube 27 having a swelled outer diameter into the vertical hole 44, there is heightened a contact pressure with the vertical hole 44 which is a rigid body, thereby preventing the side leakage of the fuel gas and the disengagement of the tube 27.

The joint tube 27 is bent in the region of the lower end of the first flow passage so as to press-fit with the rear end bent portion 31*a* of the tip nozzle pipe 31. The tip nozzle pipe 31 has a large diameter portion 31*b* which is clamped between the inner wall surface of the flame hole cover 20 and the outer wall surface of the combustion cylinder 16 and the spacer ring 126, and whose lower end is partly supported on the flange 13 of the diffusion holder 117. In this embodiment, the distal end 47*c* of the tip nozzle pipe 31 opens into the interior of the combustion cylinder 16. It will be understood that a plurality of openings may be provided on the distal end 47*c* of the tip nozzle pipe 31 instead of providing a single opening. Further, the joint tube 27 may be rejected by directly connecting the rear end of the tip nozzle pipe 31 into the vertical hole 44. Alternatively, the vertical hole 44 may be also rejected by connecting it into the flow groove 43.

In the diagrams, reference numeral 22 denotes a closure or a closing cap mounted on the top of the case 1. The closure 22 is provided with an operation button 50 supported on a spring 49. The closing cap 22 has a pivotal support 51 partly designated by a broken line which is pivotally mounted on a support piece 52. Reference numeral 53 denotes a nozzle lever operating the joint pipe 3 and partly designated by a broken line.

Although the second embodiment of the present invention is thus configured, the shape of the catalytic member 130 or the mounting structure thereof is not restricted to this. By way of example, a spiral catalytic member 130*a* may be employed as shown in FIGS. 13 and 14B.

Description will now be given of action of the gas lighter thus configured in accordance with the second embodiment of the present invention.

When the closure 22 is turned in the direction indicated by an arrow A, a nozzle lever 53 pulls up the joint pipe 3 to release the on-off valve mechanism 107, thereby allowing the fuel gas derived from the fuel tank to be ejected and through the suction passage 5*a* diverge into the bore 3*a* of the joint pipe 3 and the mounting hole 134*a* (key groove 133). With the ejection of the fuel gas, the high-voltage generator 127 is actuated to generate a discharge between the discharge electrode 17 and the catalytic member 130(130*a*) within the combustion cylinder 16. The resultant discharge spark ignites the premixed gas within the combustion cylinder 16 to produce a premix flame in a complete combustion state, the base for the combustion flame being located at a deeper portion within the combustion cylinder 16 corresponding to the upper portion of the catalytic member 130(130*a*). It is to be noted that the discharge by the target of the discharge electrode 17 may be an exclusive terminal provided within the combustion cylinder 16 without being limited to the catalytic member 130 (130*a*).

In the second flow passage, on the other hand, the flow of the fuel gas ejected from the key groove 133 through the mounting hole 134*a* into the mounting hole 134*b* is regulated by passing through the pressure control member 41. The fuel gas having a regulated flow passes through the joint tube 27 and is ejected into the opening of the combustion cylinder 16 from the distal end 47*c* of the tip nozzle pipe 31. The ordinary fuel gas which has passed through the second flow passage is ignited by the premix flame previously burning in the combustion cylinder 16, to produce a diffuse flame which is a common reddish yellow, visible flame. Thus, the diffusion flame can be obtained from the tip nozzle 21.

As described above there is configured and operated the gas lighter in accordance with the present invention. The provision of the externally operated fuel gas flow control mechanism in the middle of ejection flow passage of the fuel gas generating a diffusion flame easily ensures a balancing between the gas ejection amounts of the first and second flow passages for obtaining a combustion flame suitable for the ignition. Further, the proximity of the catalytic member to the diffusion mechanism ensures an initial presence of the premix gas immediately below the catalytic member, thereby obtaining a secure catalytic reaction due to the catalytic member from the initial ignition time. The resultant diffusion flame presents a clear combustion criticality without exhibiting any assimilation phenomena with the premix gas.

What is claimed is:

1. A gas lighter having a housing and a fuel tank storing a fuel gas within said housing, comprising:

a combustion cylinder in said housing;

first passage means for supplying an air-fuel gas mixture to said combustion cylinder, said first passage means being fluidly connected with said fuel tank and said combustion chamber;

ignition means in said combustion cylinder for igniting said air-fuel gas mixture in said combustion cylinder to produce a premix flame;

a flame hole in said housing and in alignment with said combustion cylinder, through which said premix flame extends out of said housing;

a nozzle hole in said housing at a position adjacent to said combustion cylinder, said nozzle hole being juxtaposed to said flame hole;

second passage means for supplying said fuel gas to said nozzle hole such that said flame extending out of said flame hole ignites said fuel gas escaping from said nozzle hole to produce a diffusion flame;

a common on-off valve mechanism for supplying said fuel gas commonly to said first and second passage means; and a single actuation means for activating said common on-off valve mechanism so that said fuel gas is simultaneously supplied to said first and second passage means.

2. A gas lighter according to claim 1, wherein said second passage means includes:

a joint tube connected between said fuel tank and said nozzle hole;

a gas ejection barrel for restricting flow of said fuel gas to said nozzle hole, said gas ejection barrel being press-fit into one end of said joint tube;

a connecting passage having a fixed size opening, said connecting passage connecting said fuel tank with said joint tube; and an enlarged diameter end portion of said joint tube being resiliently press-fit into said fixed size opening of said connecting passage.

3. A gas lighter according to claim 1, wherein:

said flame hole extends along a vertical axis, and said nozzle hole is positioned adjacent to said flame hole and extends along an axis that is angled away from said vertical axis to provide a diagonally upward ejection of said fuel gas from said nozzle hole.

4. A gas lighter having a housing and a fuel tank storing a fuel gas within said housing, comprising:

a combustion cylinder in said housing;

first passage means for supplying an air-fuel gas mixture to said combustion cylinder, said first passage means being fluidly connected with said fuel tank and said combustion chamber;

ignition means in said combustion cylinder for igniting said air-fuel gas mixture in said combustion cylinder to produce a premix flame;

a flame hole in said housing and in alignment with said combustion cylinder, through which said premix flame extends out of said housing;

a nozzle hole in said combustion cylinder at a position above said ignition means, for supplying said fuel gas to said flame hole;

second passage means for supplying said fuel gas to said nozzle hole such that said premix flame in said combustion chamber ignites said fuel gas escaping from said nozzle hole to produce a diffusion flame that extends out of said flame hole and which burns together with said premix flame; and an externally operable fuel gas flow control mechanism provided in said second passage means to control the flow of said fuel gas to said nozzle hole.

5. A gas lighter according to claim 4, wherein said fuel gas flow control mechanism includes a movable member in said second passage means for controlling the flow of said fuel gas in said second passage means.

6. A gas lighter according to claim 5, further comprising a catalytic member positioned upstream of said premix flame.

* * * * *